US006709351B2

(12) United States Patent
Hori

(10) Patent No.: US 6,709,351 B2
(45) Date of Patent: Mar. 23, 2004

(54) SPORTS GAME SYSTEM

(76) Inventor: Takeshi Hori, 5-25, Hamasuga, Chiga-shi, Kanagawa-ken (JP)

( * ) Notice: Subject to any disclaimer, the term of this patent is extended or adjusted under 35 U.S.C. 154(b) by 22 days.

(21) Appl. No.: 09/772,978

(22) Filed: Jan. 31, 2001

(65) Prior Publication Data

US 2001/0056000 A1 Dec. 27, 2001

Related U.S. Application Data

(63) Continuation-in-part of application No. 09/150,190, filed on Sep. 10, 1998, now abandoned.

(51) Int. Cl.[7] ..... A63F 13/00
(52) U.S. Cl. ..... 473/455; 473/453; 463/3
(58) Field of Search ..... 473/453, 451, 473/455; 273/440, 454, 448, 459–461; 463/3–4

(56) References Cited

U.S. PATENT DOCUMENTS 4,442,823 A 4/1984 Floyd et al.
4,659,090 A 4/1987 Kustanovich
4,751,642 A * 6/1988 Silva et al. ..... 463/34
4,915,384 A 4/1990 Bear
5,419,549 A 5/1995 Galloway et al.
5,631,558 A * 5/1997 Yoshida et al. ..... 324/178
5,639,084 A 6/1997 Kawasaki
5,779,241 A 7/1998 D'Costa et al.
5,868,578 A * 2/1999 Baum ..... 434/247

* cited by examiner

*Primary Examiner*—S. Thomas Hughes
*Assistant Examiner*—Aaron Capron
(74) *Attorney, Agent, or Firm*—Young & Thompson

(57) ABSTRACT

A sports game system for using a ball such as baseball, soccer, cricket, tennis, etc., has two first and second separated area sensors for measuring speed and location of the ball hit or kicked by a player, monitor TVs for displaying at least speed and location of the ball, and a controller for controlling the area sensors and the multi-monitor TV, whereby the player can feel as if he were enjoying a real game.

13 Claims, 17 Drawing Sheets

2
STEP 22
SECOND AREA SENSOR ?
Y
N
STEP 22
FIRST AREA SENSOR ?
Y
N
Xn, Yn DETECT
STEP 23
Xn, Yn DETECT
STEP 25
N
TIME OUT
STEP 26
Y
STRIKE
STEP 27
CALCULATE ANGLE AND SPEED OF HIT BALL
DISPLAY LOCATION OF HIT BALL, SCORES ETC.
STEP 28
STEP 29
REMAINED BALL ZERO ?
N
Y
REMAINED BALL DECREASE
STEP 30
STEP 31
DISPLAY TELOP "THANK YOU"
4
STEP 34
DISPLAY TELOP "NOT USED"
1
CARD ALARM
STEP 32
Y
CARD ?
N
STEP 33

SPORTS GAME SYSTEM

CROSS-REFERENCE TO RELATED APPLICATIONS

This application is a continuation-in-part of application Ser. No. 09/150,190, filed Sep. 10, 1998, now abandoned.

The invention relates to a sports game system in which a player feels as if he were enjoying a real sports game.

BACKGROUND OF THE INVENTION

In conventional computer sports games such as baseball, soccer, cricket and tennis games, a player operates a joy stick while seeing an image on a monitor TV. However, he cannot enjoy the physical feeling of actual batting, hitting or kicking. This is unavailable because of the limitation of space. On the other hand, there are games such as auto race games in which an actual driving is simulated. For example, five game machines are connected with each other so that a player for each game machine can enjoy the auto race even with strangers. This kind of real experience type games appear to become more popular in the future.

Furthermore, a baseball game will now be explained. In a conventional batting cage, a player simply hits a ball thrown by a pitching machine. It is difficult to hit a ball at a good timing because he only knows the timing to be thrown from the pitching machine by watching the lighting of a lamp on the pitching machine. This is widely different from an actual baseball game. There is, in the market, a baseball game in which an image of a pitcher is projected on a screen in a synchronism with the pitching machine. In this baseball system, it requires a darken room because the images must be projected on the screen in a dark environment. On the other hand, a bright room is necessary for hitting ball at a speed of 135 km per hour and more. In this case, it is necessary to cover the screen to prevent light from coming in. This cover around the screen can be obstacle for a ball hit by the player. There is also a problem of wrinkled screen and distorted image on the screen. Some game systems utilize an LED monitor to avoid such problems. The LED monitor is bright enough, but it is fairly expensive and does not have a good resolution.

SUMMARY OF THE INVENTION

It is an object of this invention to provide a sports game system in which a player can feel as if he were in a real game.

According to this invention, there is provided a sport game system in which a player uses ball, comprising an area sensor means for measuring speed and location, in a play field, of a ball hit or kicked by a player; a display means for showing at least a location, in the play field, of the ball; and a controller for controlling said area sensor means and said display means.

Further objects, features and other aspects of this invention will be understood from the following detailed description of the preferred embodiments of this invention with reference to the drawings.

DETAILED DESCRIPTION OF THE INVENTION

Figure 1:
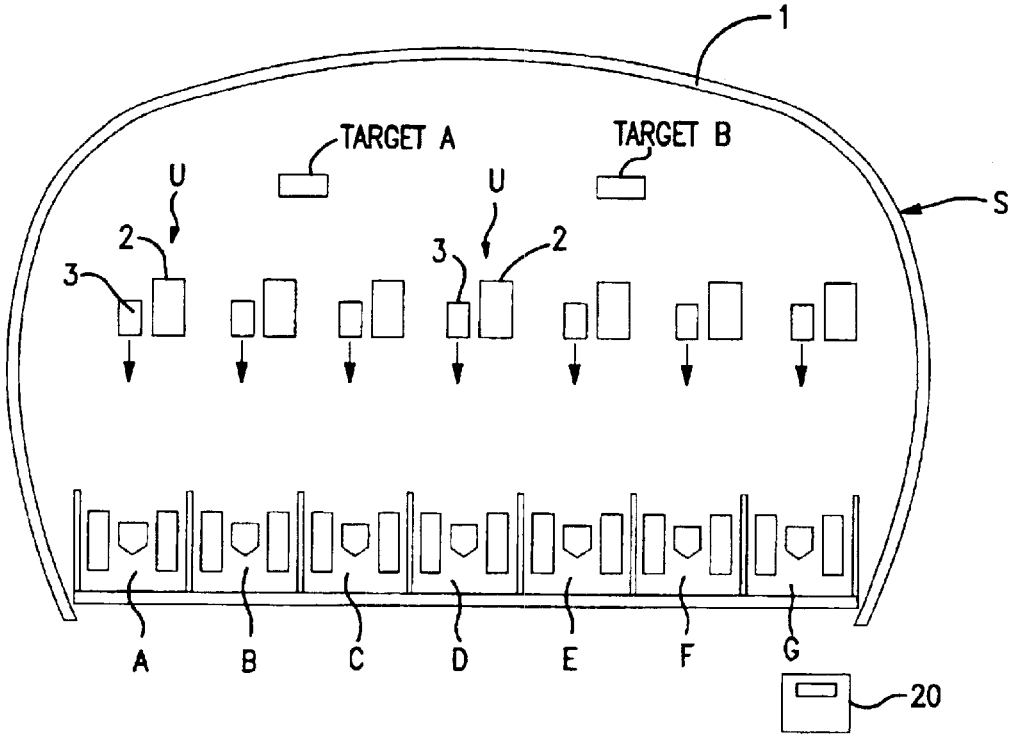
FIG. 1 shows a plan view of a batting cage.
Figure 2:
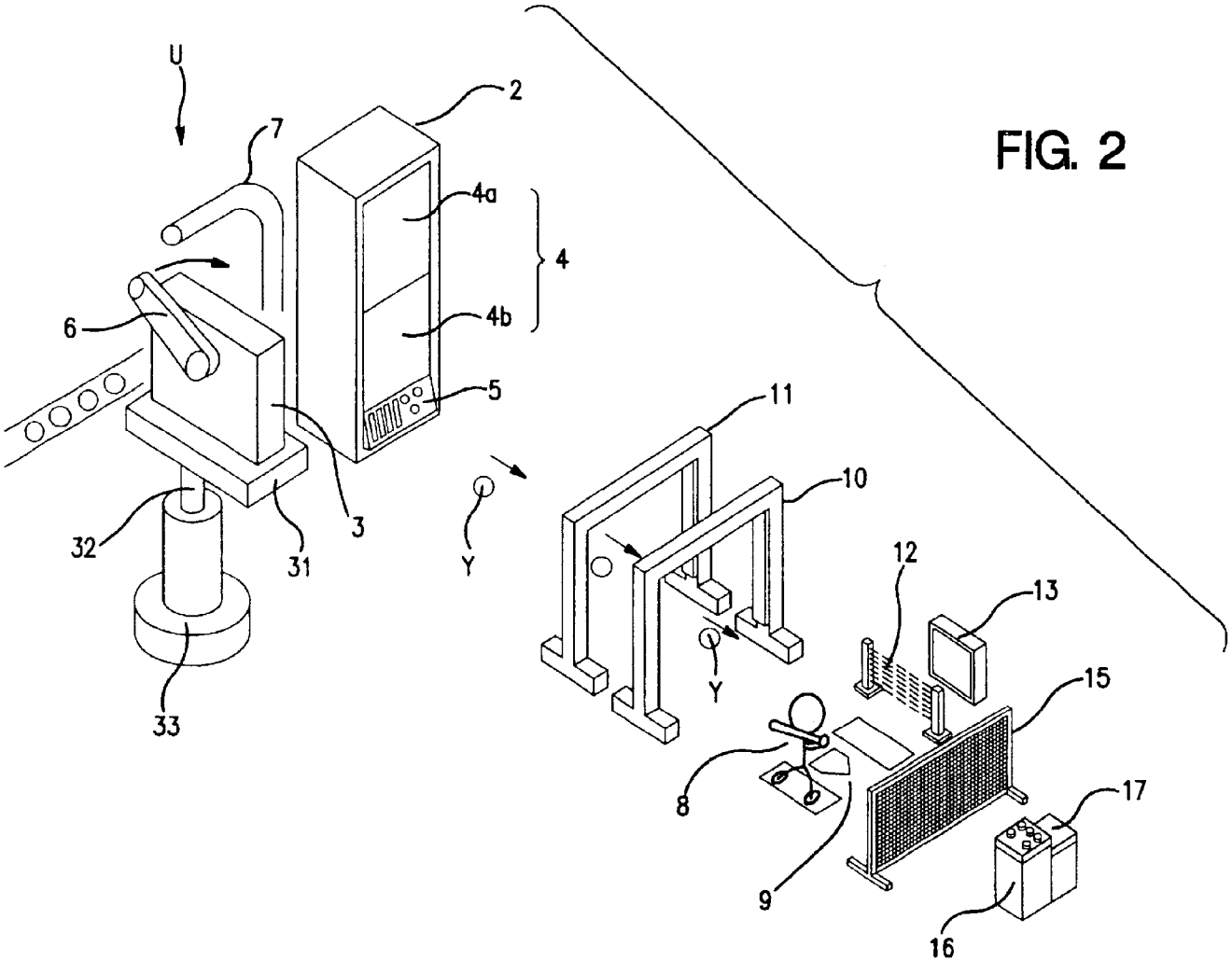
FIG. 2 shows a perspective view of a pitching unit and a batting lane.

In FIG. 1, a baseball game stadium (batting center) S has a circular fence 1 in which a plurality of pitcher's monitors 2,2 - - - 2 are disposed in line, and the same number of pitching machines 3,3 - - - 3 as ball feeding machines are provided corresponding to the pitcher's monitors 2 so that one pitching machine 3 and one pitcher's monitor 2 form a pitching unit U. At the end portion of the fence 1 are provided a plurality of batter's boxes (lanes) A, B, C - - - G in line corresponding to the pitching units U. As shown in FIG. 2, the pitcher's monitor 2 of the pitching unit U provides almost life-size images and has a multi-screen 4 which comprises an upper screen 4*a* and a lower screen 4*b*. An image processor 5 is provided under the lower screen 4*b*. The pitching motion of a certain baseball pitcher as a ball feeding person is on the multi-screen 4. The pitching machine 3 provided adjacent the pitcher's monitor 2 operates synchronously with the pitching motion of the pitcher. The pitching machine 3 has a throwing arm 6, and a ball 8 is supplied to the upper end of the arm 6 one by one through a ball feeder 7. The throwing arm 6 throws a ball to a batter 8, as a player, standing in the battery box 9. Along the path of the ball r are provided, at a predetermined space, a first area sensor 10 and a second area sensor 11 in the form of a gate, which detect the speed and position of the ball r. A pitched ball height sensor 12 is provided in front of a the batter 8 so that the batter 8 can determine the height of the ball path by himself, and a hit ball monitor 13 as a display means for showing a location of a hit ball is provided near the sensor 12 in a manner that the batter 8 can see the screen. That is, the hit ball monitor 13 shows the position on the baseball field, of the ball r hit by the batter 8. A microphone 14 is disposed above the batter box 9 to pick up the sound of the batting, and a camera 110 is also installed near the monitor 13. Then a still picture of a batter hitting ball can be shown on the screen in the still mode when the batting sound is picked up by the microphone 14. In the normal mode, the hit ball monitor 13 shows the diagram indicating the position of a hit ball when a hit ball goes through the area sensor 11.

The ball r passing over the batter box 9 strikes against a fence 15 which drops the ball 4 downward so that the ball r can be collected to send it to the pitching machine 3 through a conveyor, a lifter and the ball feeder 7. Further, a controller 16 is provided for controlling the whole system, and a printer 17 is also provided for outputting the result of the batting. At the entrance of the stadium S is located a card vending machine 20 (FIG. 1) for selling a card which is inserted into the controller 16 by a player. Then, the player sets, for example, the number of the batting on the controller 16.

Figure 3:
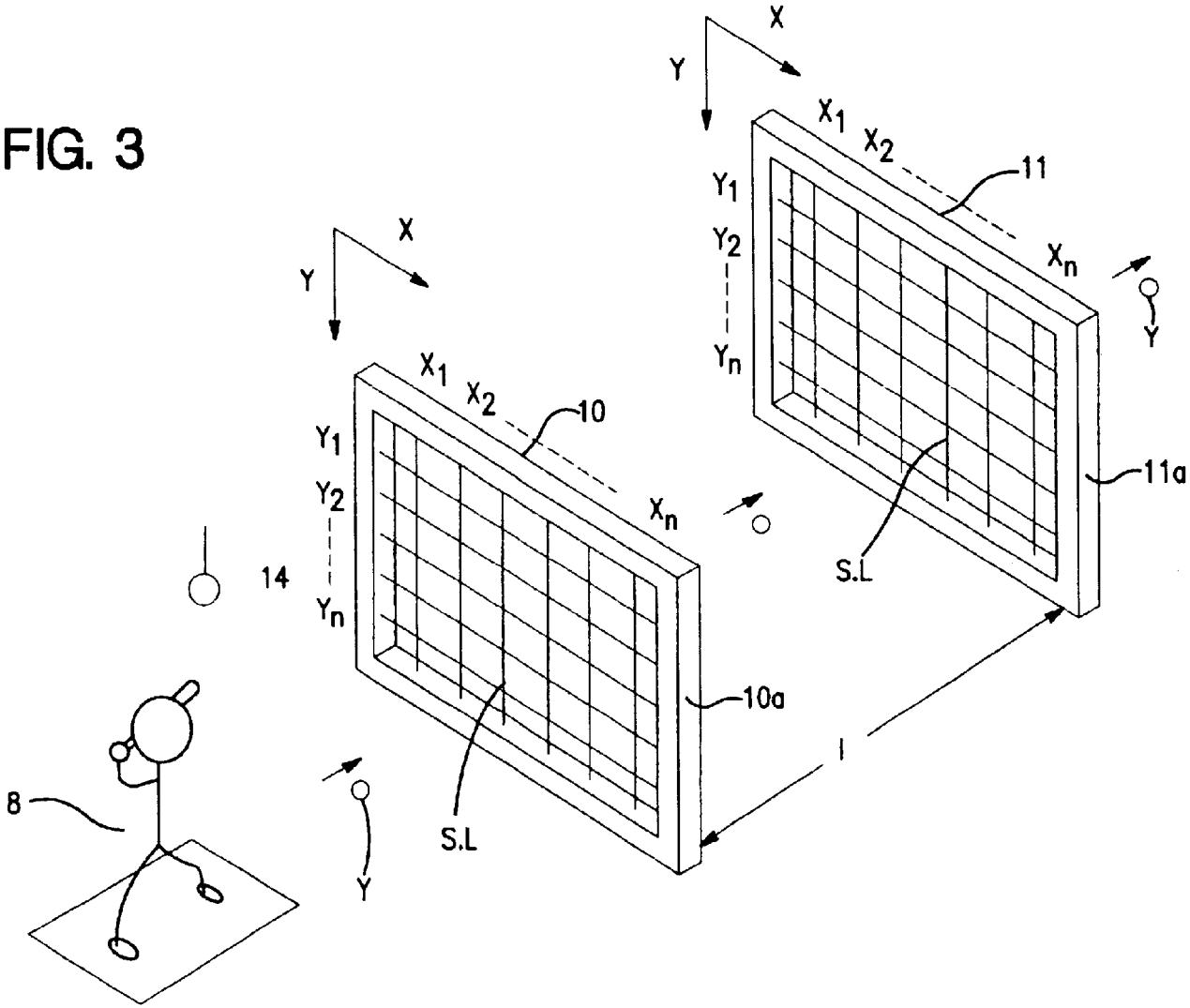
FIG. 3 shows a perspective view of first and second area sensors.
Figure 4:
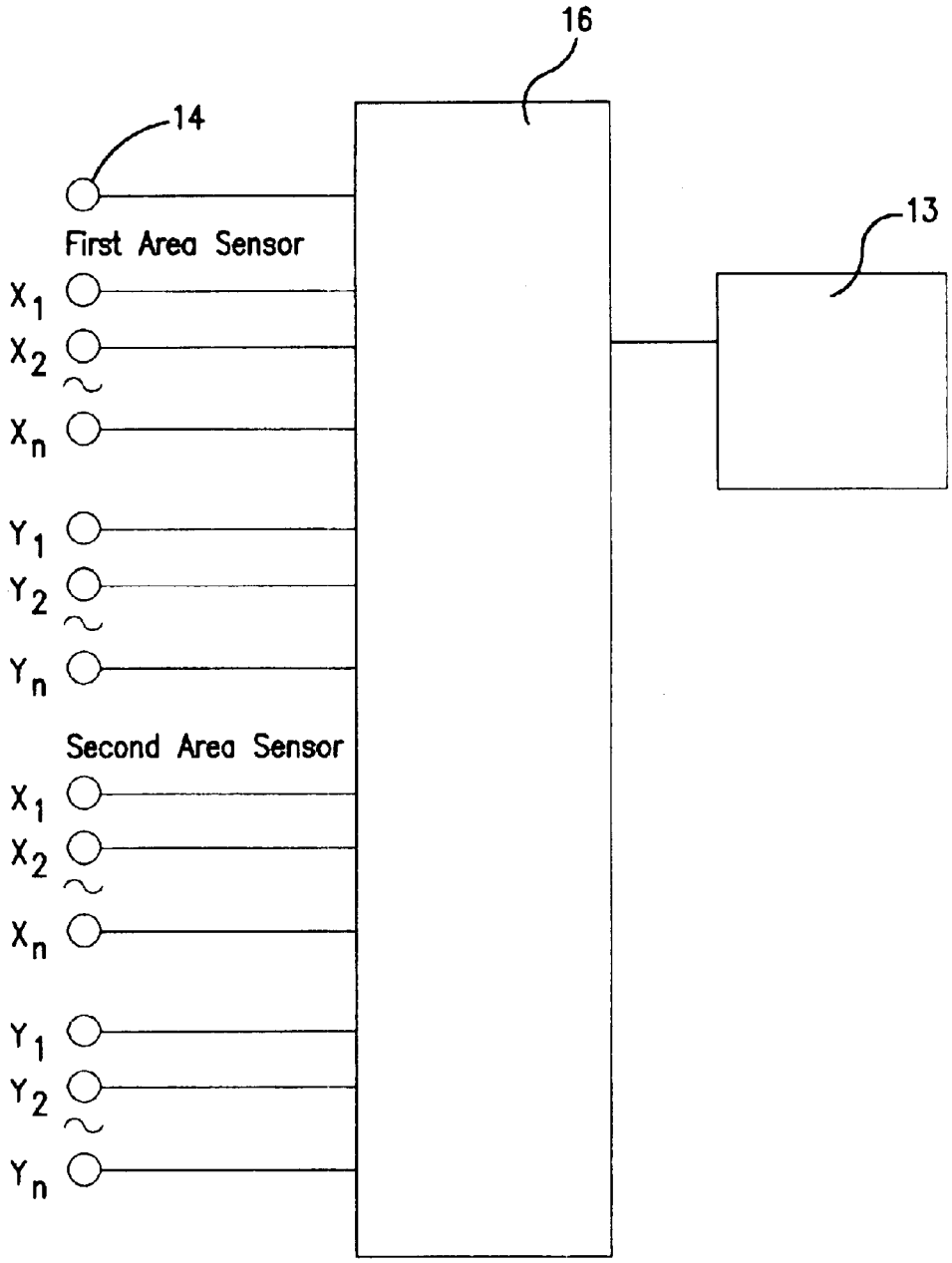
FIG. 4 shows a block diagram of a hit ball monitor.

Each of the first and second area sensor 10, 11 forms, shown in FIG. 3, a line sensor. They are separated by the distance l. Each of the area sensors 10, 11 has a frame 10*a*, 11*a* on which a plurality of sensing elements are disposed. In each sensor, a plurality of sensing lines ($X_1$, $X_2$ - - - $X_n$, $Y_1$, $Y_2$ - - - $Y_n$) are disposed in the form of grid. The sensing lines are infrared rays and infrared ray emitting and receiving elements (radiation and reception) are disposed along X and Y axis directions. In order to detect the position of the ball r accurately by using the sensors 10, 11, it is preferable that the ball crosses two sensing lines. That is, the diameter of the ball r should be larger than the pitch of the grid. For example, a normal ball has a diameter of 72 mm. In this case, the pitch of the sensing lines S, L is just 36 mm or a little bit larger than 36 mm. The ball r is round, and accordingly, the position of the center of the ball can be calculated in comparison with the times of interception of two sensing lines. The speed of the ball r hit by the batter 8 can be detected by measuring the length of time when the ball r passes the distance l between the two area sensors 10, 11. Further, the direction of the ball r hit by the batter 8 is calculated by detecting the positions at which the ball r hit by the batter 8 goes through the two area sensors 10, 11. The field position to which the hit ball reaches is calculated on the basis of the ball speed and the ball passing positions of the two area sensors 10, 11.

The play field position of the ball hit by the batter 8 can be calculated also in the following manner. The area sensor 2 detects the position of the ball thrown by the pitching machine 3, and the position of the ball hit by the batter 8. Since the position of the thrown ball in the area sensor 2 corresponds approximately to the hitting position of the ball r, the direction of the ball based on the angle of the hit ball can be calculated on the basis of the two positions (thrown ball position and hit ball position) of the ball in the area sensor 2. The hit speed of the ball can be calculated on the basis of the length of time when the hit ball passes through the two area sensors 10, 11 in the above manner.

In general, wiring of the area sensors 10, 11 tends to get complicated when they are connected one by one. In order to simplify the wiring and to reduce the number of counters to measure the time when a ball goes through the sensors 10, 11, the wiring of the sensors 10, 11 is, as shown in FIG. 5, divided into three groups, two of which are connected in series.

The sensor wiring is divided into three groups as follows:

| | |
|---|---|
| A Group (separate wiring) | Element 1, 3, 5, 7, - - - |
| B Group (serial wiring) | Element 2, 6, 10, - - - |
| C Group (serial wiring) | Element 4, 8, 12, - - - |

Figure 5:
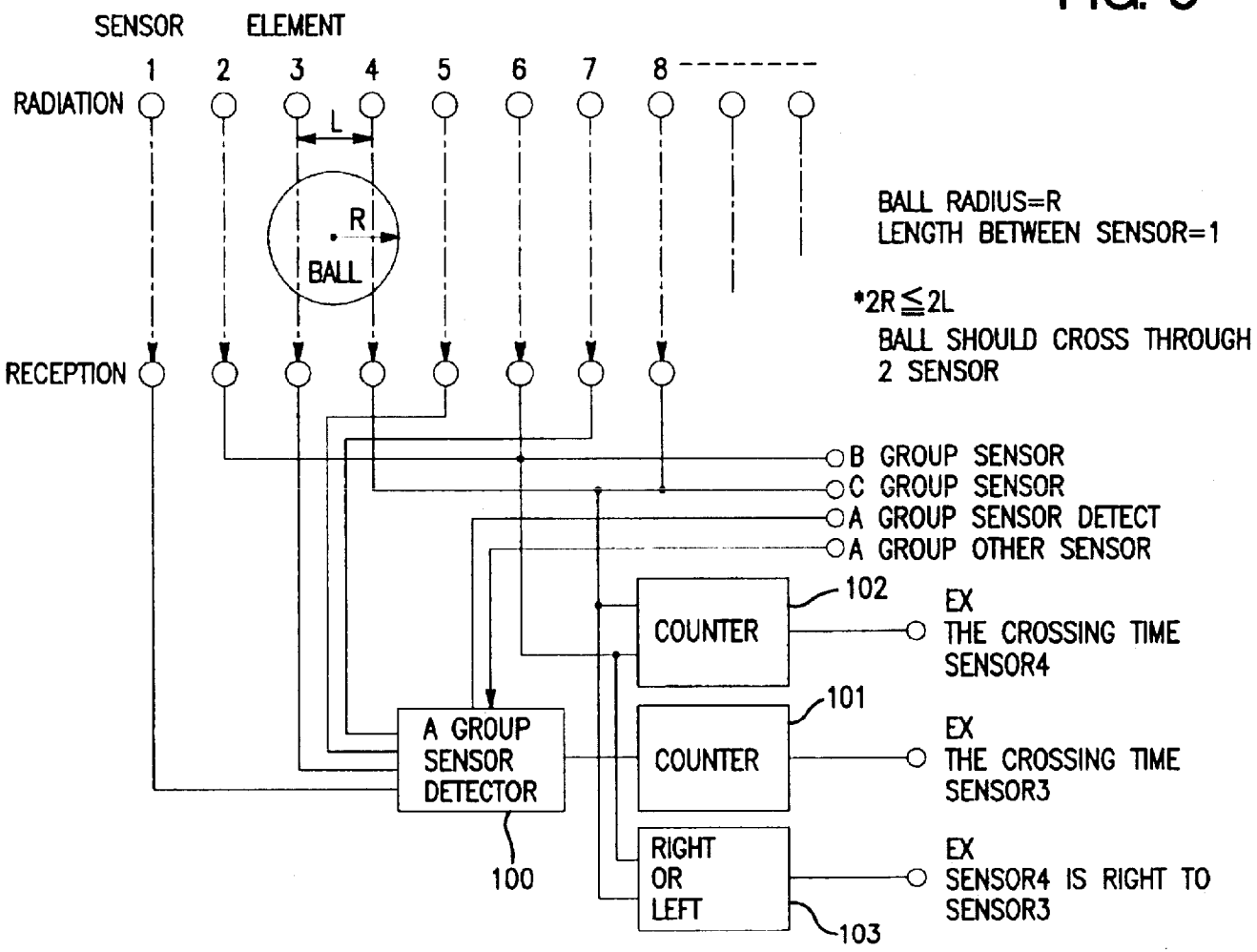
FIG. 5 shows a wiring of the area sensors.

As shown in FIG. 5, when a ball goes through two sensors (elements) 3, 4, the center of the ball can be measured accurately by comparing the times of interception of elements 3, 4 with each other. As the sensor elements in A Group are installed every other sensor element, a ball must be detected only by one of the separate sensor elements in A Group. The sensor elements in A group are connected to an A group sensor detector 100 and a counter 101, and the sensor elements in B and C Groups are connected in serial to a counter 102 and a right or left judging circuit 103 for judging which Group element (B Group or C Group) detects the ball. In FIG. 5, a sensor element 4 detects the ball and the sensor element 4 belongs to C Group. The right or left judging circuit 103 judges that a certain sensor element in C Group detects the ball. At this time, since the A Group sensor detector 100 detects that the sensor element 3 in A Group is operating, the right or left circuit 103 detects that the right sensor element 4 of the sensor element 3 in C Group is operating. In this manner, the center of the ball is accurately detected.

In FIG. 1, there are two homerun targets A, B on the backwall behind the pitching units U in the stadium S. In FIG. 2, the area sensors 10, 11 can detect the position approximately in the stadium of the ball hit by the batter 8, and, therefore, the controller 16 memorizes who has hit a homerun. A gift may be given to a homerun batter.

Figure 6:
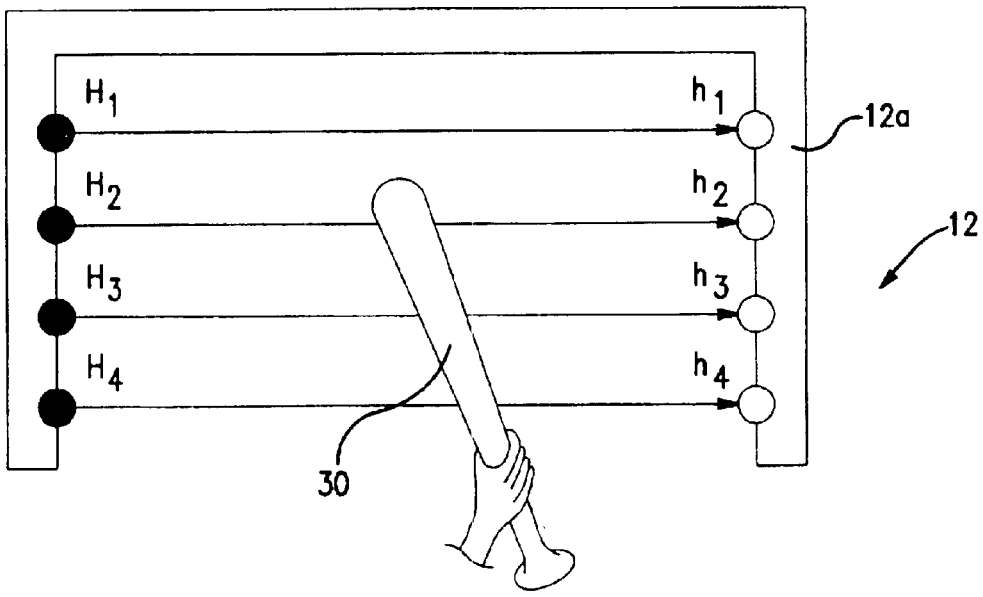
FIG. 6 shows a front view of a pitched ball height sensor.

The above pitched ball height sensor 12 has, as shown in FIG. 6, a frame 12*a* in the form of a gate. The sensor 12 functions as a ball position determining device for determining the position of a ball desired by a player. One vertical frame has a plurality of infrared ray emitting elements $H_1$, $H_2$, - - - $H_4$ at a predetermined pitch, and the other opposite vertical frame has a plurality of infrared ray receiving elements $h_1$, $h_2$, - - - $h_4$ corresponding to the infrared ray emitting elements, respectively. When the batter 8 holds his bat 30 in the frame at a certain height he wishes, his bat 30 blacks off a certain infrared ray with his bat 30, and his desired height position is sent to the pitching machine 3 to adjust the machine to his desired height position. That is, the pitching machine 3 has a table 31 (FIG. 2) which is supported by a shaft 32. The shaft 32 is engaged with a base 33 so as to be moved upward and downward by a step motor (not shown). The table 31, the shaft 32, and the step motor, etc., function as a ball feeding position adjustment means. It is also possible to change the height of pitched ball at random by using a computer.

Figure 7:
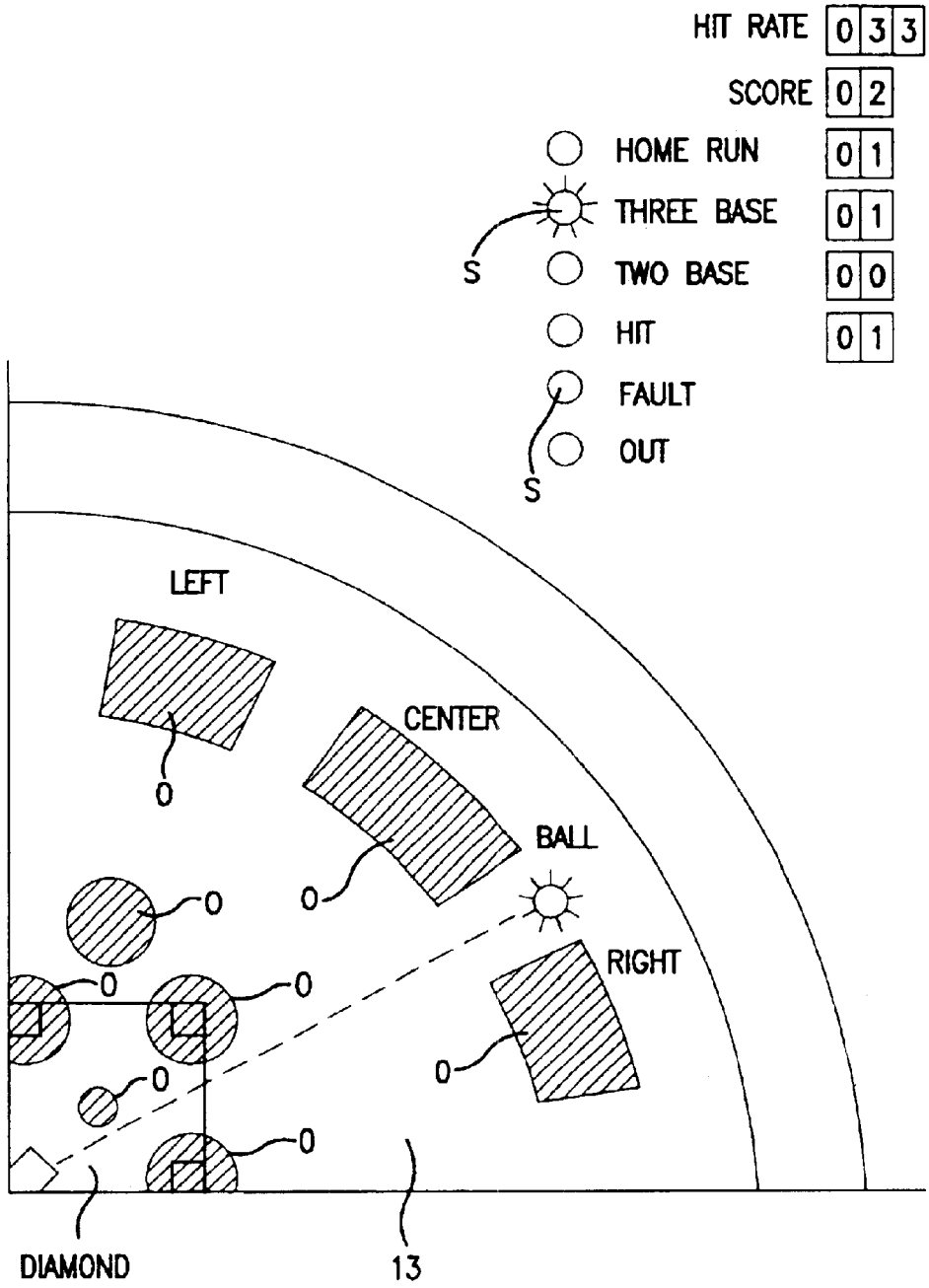
FIG. 7 shows a screen of the hit ball monitor.

FIG. 7 shows an image displayed on the screen of a hit ball monitor 13. That is, the image shows a baseball field including home-run zone 78, eight field player zones (indicated by crossed lines) 70-77 and the indicator lamps for home-run 80, three base hit 81, two base hit 82, other hit 83, fault 84, out 85, respectively, as well as the numbers of earned scores 87, average 86, and the remaining balls 88. When a ball r hit by a player goes through sensors 10 and 11, the position of the ball is calculated based on the position of the sensors where the ball cut through and the length of time taken by the ball going from sensor 10 to sensor 11. When the hit ball goes into the circled field player zones 70–74, the ball is considered out and the lamp for out 85 turns on. On the other hand, when the ball rolls into the rectangular field player zones 75, 76, 78, it is considered a hit and the lamp for hit 83 turns on and its number increases. In the case of fault, the lamp for fault 84 turns on. In the case a ball goes into the other areas but the field player zones, it can be either two base hit or three base hit.

The track of a ball hit by a player is indicated by an extending line 89. When the hit ball falls on the ground and bounds, the position of the bound is indicated by a black, dot. The end of the ball track flushes to indicate the ball stops moving. In the case, the ball is a hit, runners indicated as color dots move to the next base like in a real game. The player can then earn scores when the runner gets to the home base, which increases the number of home-run on the monitor. The number of average changes according to the result of a batting everytime the player hits a ball. At the end of game, the player can print out the result of his batting on a sheet of paper which shows the tracks of all the balls with lines.

To increase entertainment value for audience, the same image shown on the hit ball monitor can be displayed on a similar monitor installed outside the batter box, visible form the audience.

Figure 8:
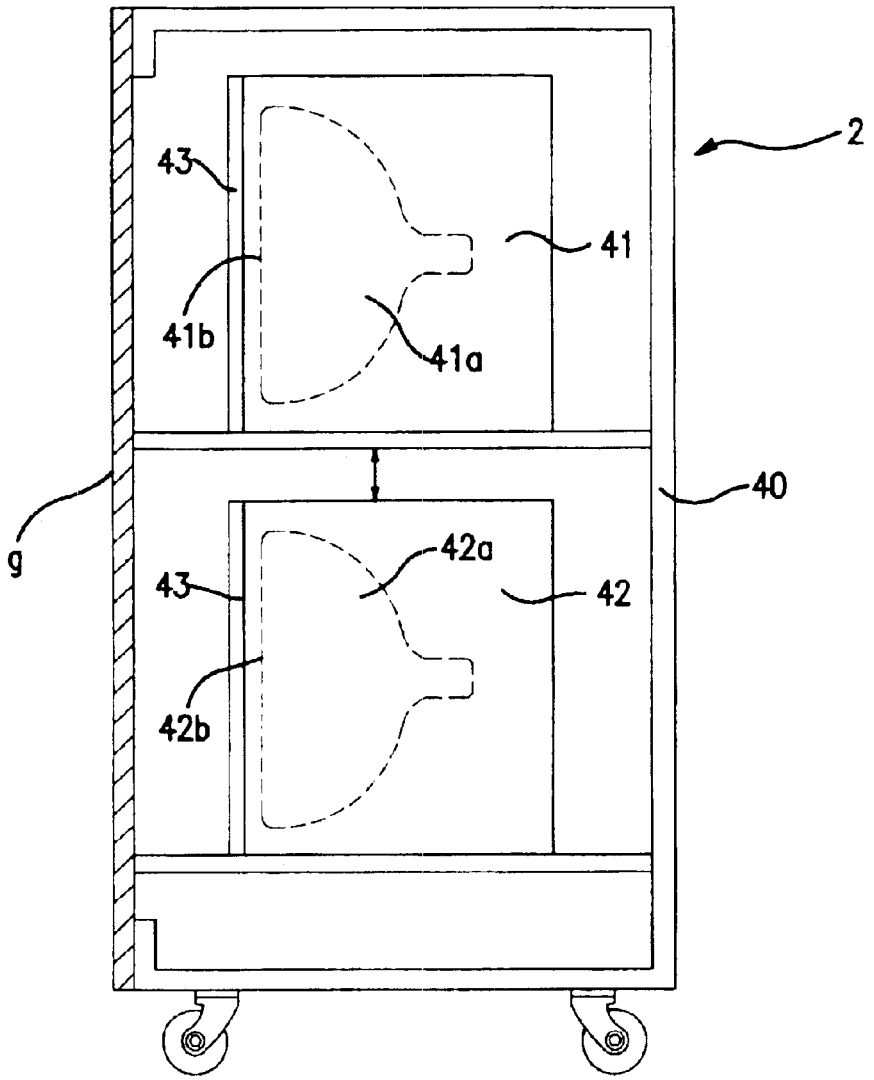
FIG. 8 shows a structure of a pitcher's monitor.
Figure 9:
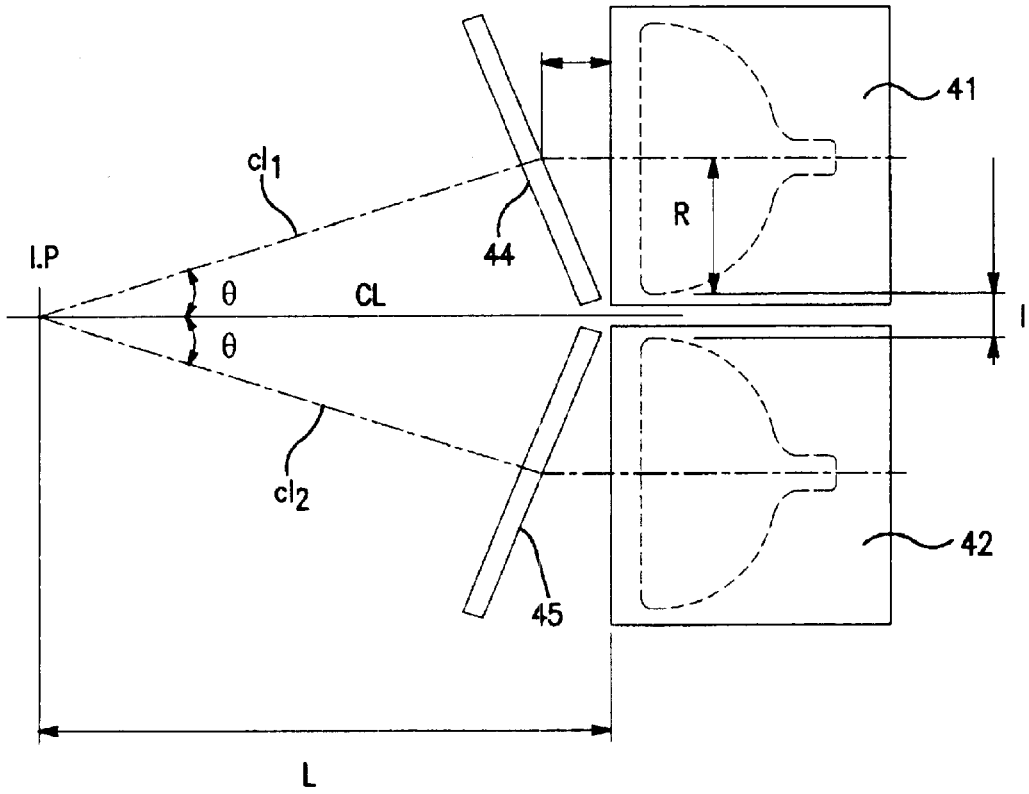
FIG. 9 shows a structure of a pitcher's monitor.

The pitcher's monitor 2 has a casing 40 in which two upper and lower television units 40, 41 are disposed vertically, and lenses 43, 43 on their front sides, as shown in FIG. 8. Moreover, a reinforced glass g is installed in front of the lenses 43*a*, 43*b* to protect them. The tube 41*a* of the upper television unit 41 is disposed over the tube 42*a* of the lower television unit 42 with a distance l in between. An image of a pitcher appears integrally on the screens 41*b*, 42*b*. However, if the upper and lower television units 41, 42 are disposed separately, the batter sees the image of a pitcher divided in half on the lenses 43*a*, 43*b*. Therefore, in this invention, as shown in FIG. 9, an upper lens 44 for the upper television unit 41 and a lower lens 45 for the lower television unit 42 are disposed obliquely in such a manner that the center lines $cl_1$, $cl_2$ are directed to the eye position e.p. of the batter 8. An oblique angle between the center 5 lines $cl_1$, $cl_2$ and a center line CL between the upper and lower television units 41, 42 is calculated by the following numeral formula.

$$\tan\theta = \frac{R + r\tan\theta}{L}$$

$$\theta = \tan^{-1}\frac{R}{L - r}$$

Wherein R is a half value of the height of each tube 41*a*, 41*b*, r is the distance between the center of the upper lens 44 and the front face of the upper television unit 41, and L is the distance between the front face and the eye position e.p. of the batter 8.

When the oblique angle θ is determined in the above manner, the batter can see the integral image of the pitcher's motion without a gap between the upper and lower images. That is, the image on the upper screen are connected with (not separated from) the image on the lower screen.

Figure 10:
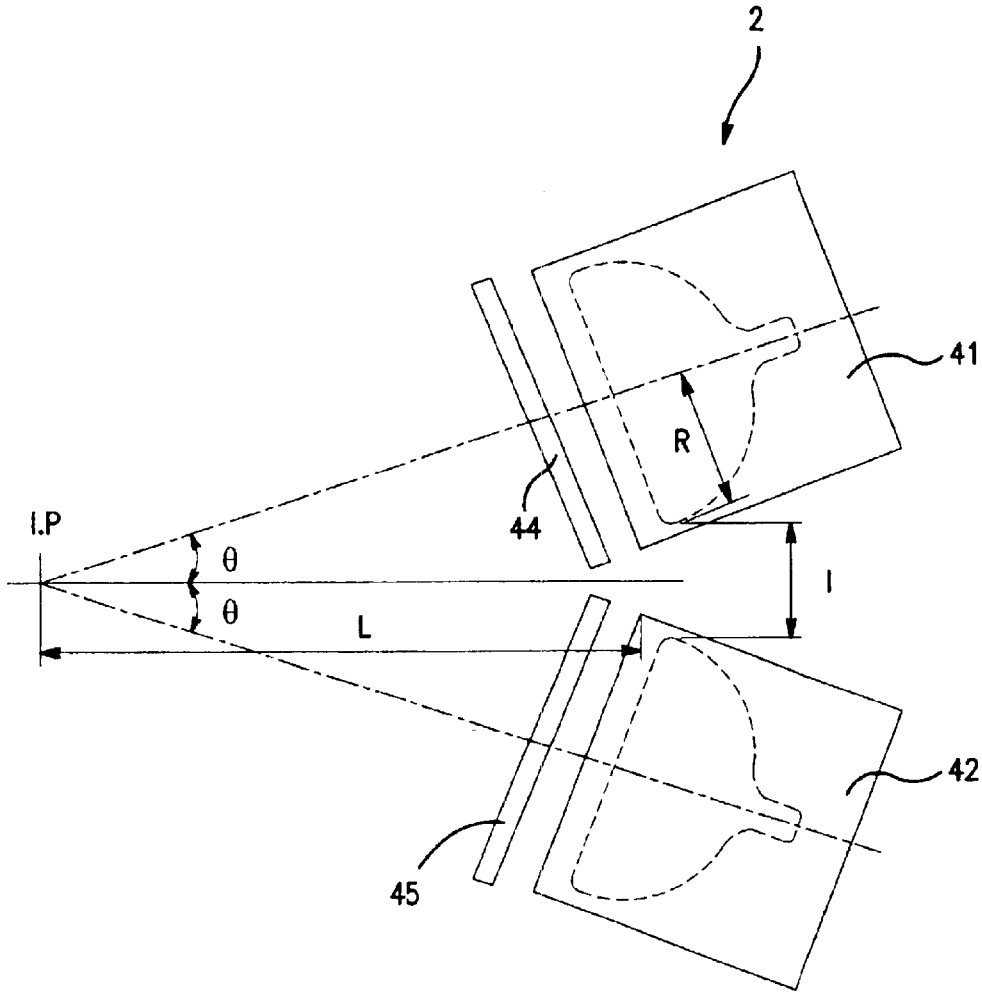
FIG. 10 shows a structure of a pitcher's monitor.

In order to make an integral image on the screen of the pitcher's monitor 2, the upper and lower television units 41, 42 may be, as shown in FIG. 10, inclined in opposite directions. In this case, the oblique angle θ at the eye position is determined in the following manner.

$$\mathrm{Sin}\,\theta = \frac{R + \frac{l}{2}\mathrm{Sin}\theta}{L}$$

$$\theta = \mathrm{Sin}^{-1}\frac{R}{L - \frac{l}{2}}$$

Figure 11:
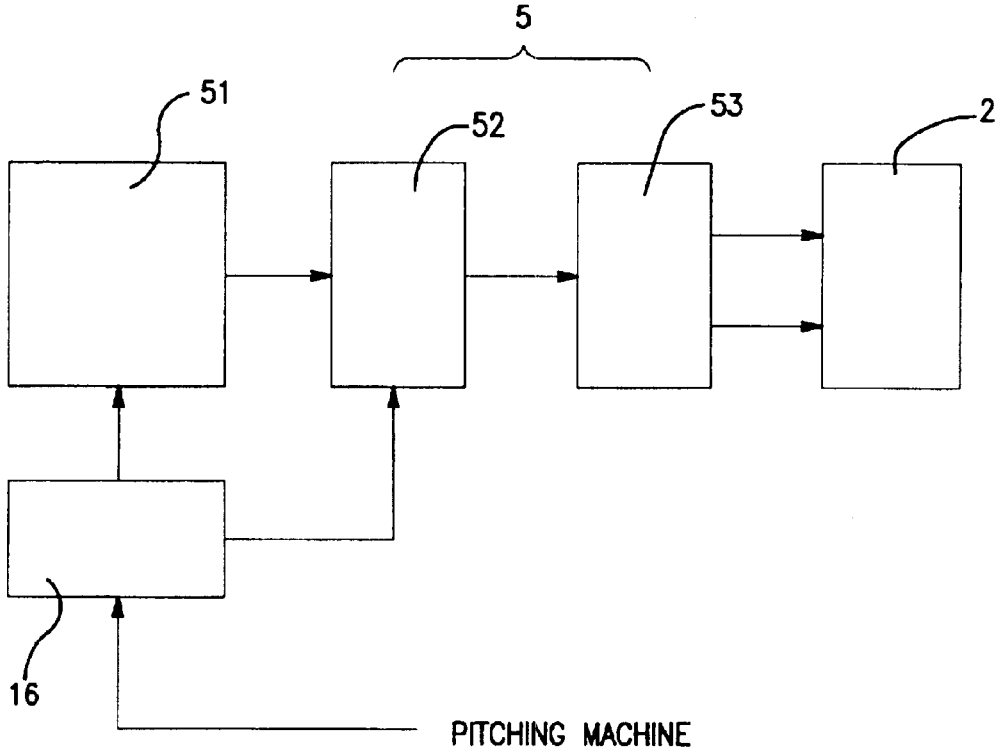
FIG. 11 shows a block diagram of the pitcher's monitor.

The image processor 5 provided in the pitcher's monitor 2 has, as shown in FIG. 11, a digital memory 52 for receiving image information from a video CD player and an image enlarging means 53. The images of a pitcher in the Video CD player 51 is stored in the digital memory 52 in the image processor 5. A pitcher's image from the video CD player 51 is sent out to the image processor 5 of the pre-specified lane through operating switches of the controller 16. That is, when an operator of the batting cage manipulates a main controller, a new pitcher's image is delivered to the image processor 5 of a desired batting lane. The new pitcher's motion is stored in the digital memory 52 in the form of a digital signal.

Figure 12:
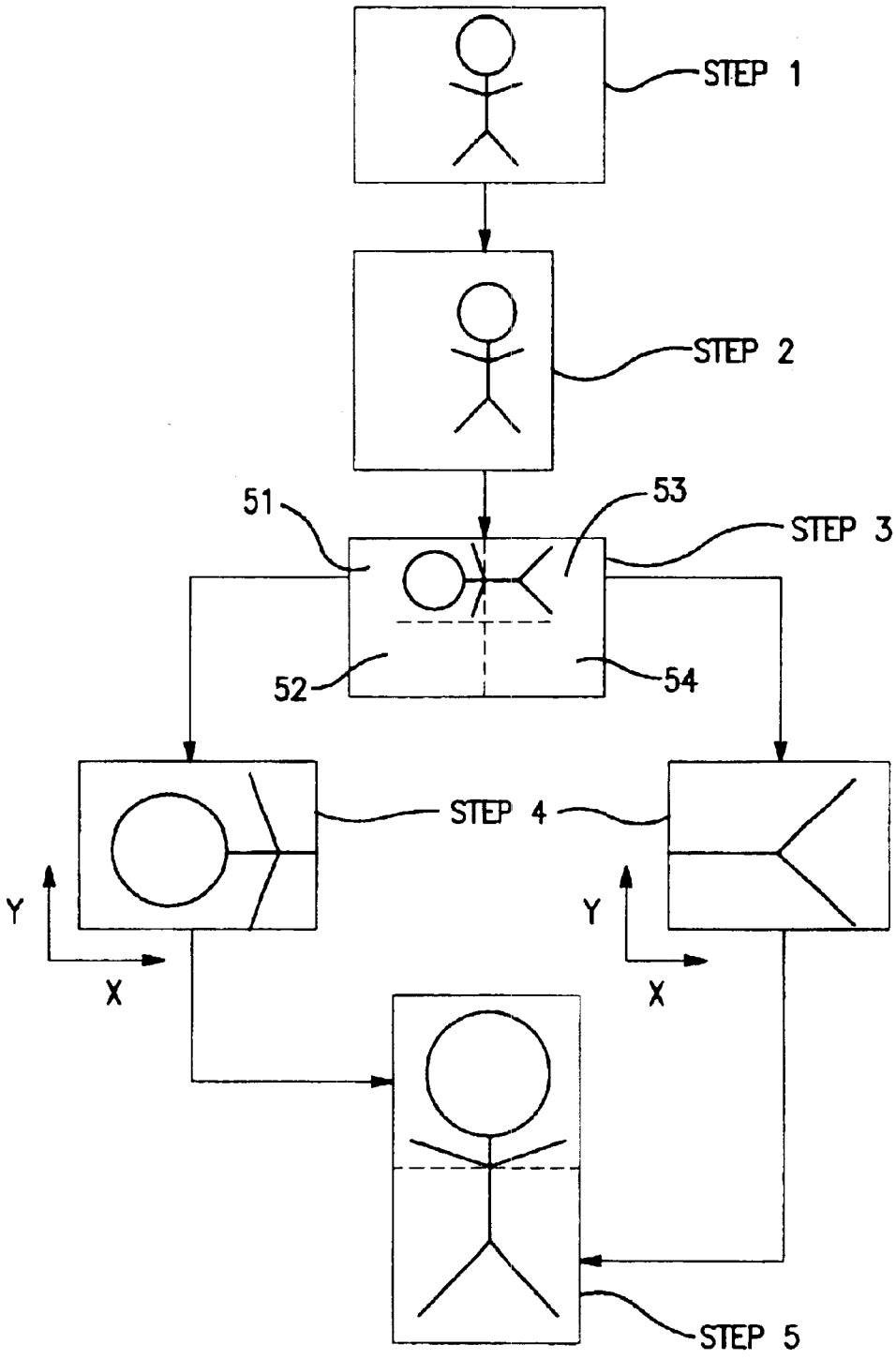
FIG. 12 shows a process for enlarging an image picture for the pitcher's monitor.

Normally a video CD is used to send out an image to a monitor. Under the current system, there is a high risk of break-down of a mechanical driving device due to wear even in the case of a contact-lens laser pick-up system if an image is shown repeatedly over and over in a short time. For instance, in the case of the pitching motion, the three second long image is repeated 9000 times per day and 300,000 times per month. It is likely that the driving device will break down in a half year or so. However, in this invention, the image of video-CD is sent to the digital memory 52 of each lane only once a day to be stored digitally for reply, and the stored digital image is then sent to the pitcher's monitor 2 every time a player starts a game. Therefore, the frequency of playing the video CD is remarkably reduced to avoid wear out due to the mechanical operation. Therefore, the life of the system is remarkably extended. Further, when a player wishes to change to a new pitcher's image, he operates the controller 16 to send the new image of the video CD player 51 to the digital memory 52. The image of the digital memory 52 is delivered to the image enlarging device 53, and is then processed in the following manner as shown in FIG. 12. A video camera is rotated by 90 degrees through a finder in a state wherein a normal pitcher image shown in STEP 1 is maintained as it is, as shown in STEP 2. The left end of the image screen in STEP 1 is aligned with the left end of the image screen in STEP 2, so that the image of the pitcher is shifted to the right side of the image screen in STEP 2. Then, the image in STEP 2 is sent to the pitcher's monitor 2 in a state wherein the image is rotated by 90 degrees in STEP to 3. The image screen of the pitcher's monitor 2 includes four divided parts S1, S2, S3, S4. The image is displayed in two divided parts S1, S3, and, the two parts S1, S3 are separated. That is, the upper and lower bodies of the pitcher's body are separated by a picture double digitizer. Then, each divided image is doubled in both directions (X and Y directions) on the picture monitor (STEP 4). Thereafter, the doubled images are combined into one by stacking two monitors which show the upper and lower parts, respectively, by rotating the doubled images at an angle of 90 degrees. If the image is electrically processed in this manner, the use of mechanical processing device can be avoided. The pitcher's monitor 2 is a multi-monitor TV without a gap between the two monitors viewed from the batter as mentioned above and can provide a good quality bright image with high resolution inexpensively through the use of TV monitors.

Figure 14:
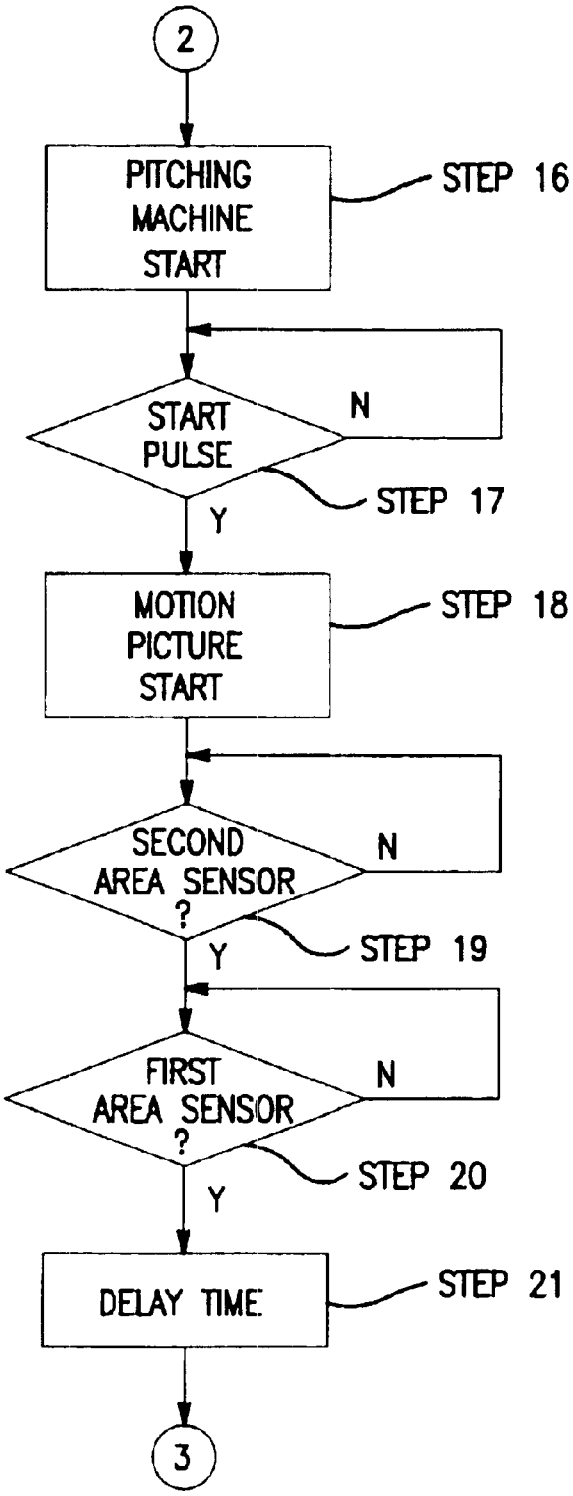
Figure 15:
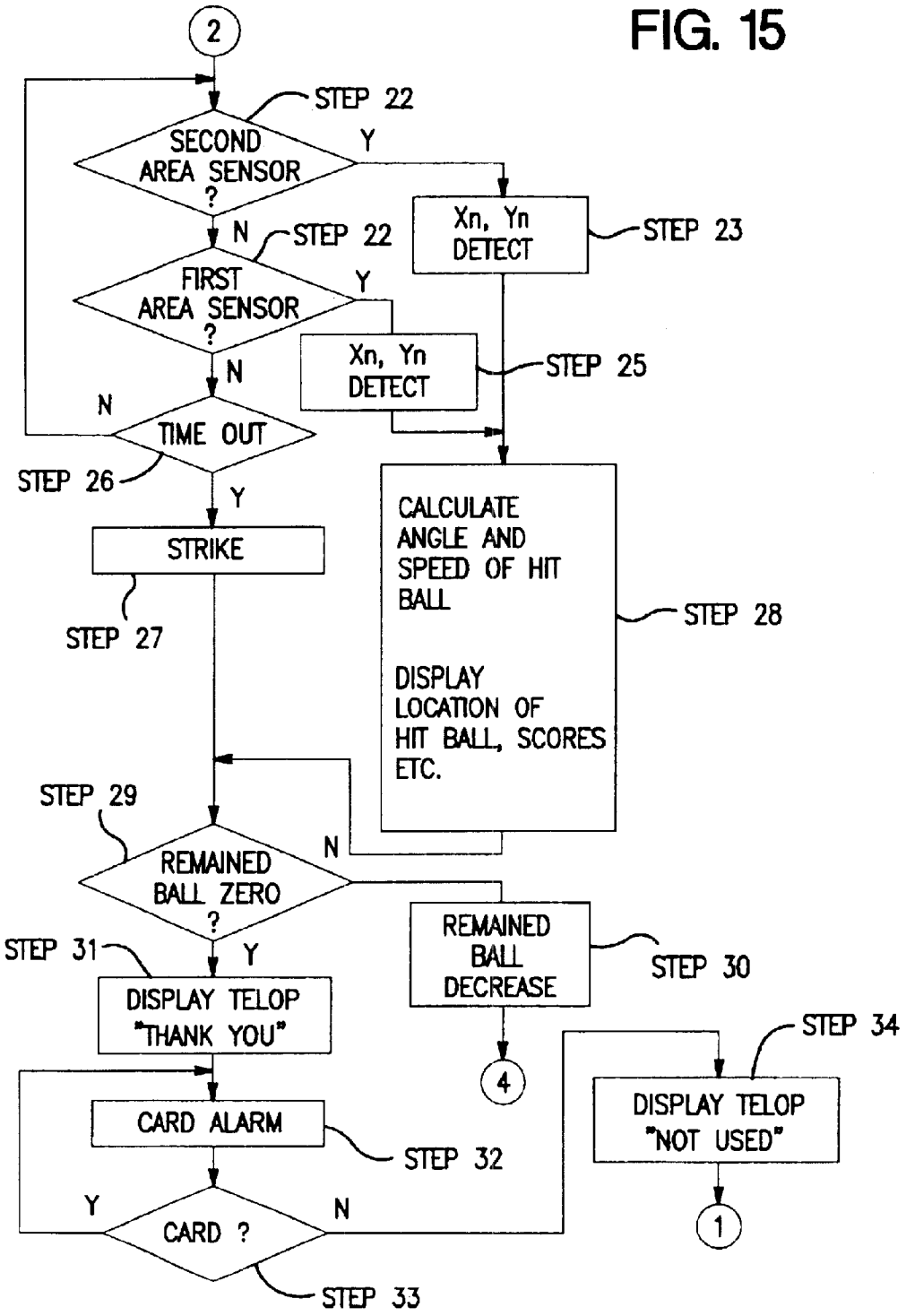

Next, the video batting system mentioned above will be explained with reference to the flow chart shown in FIGS. 13 to 15.

Figure 13:
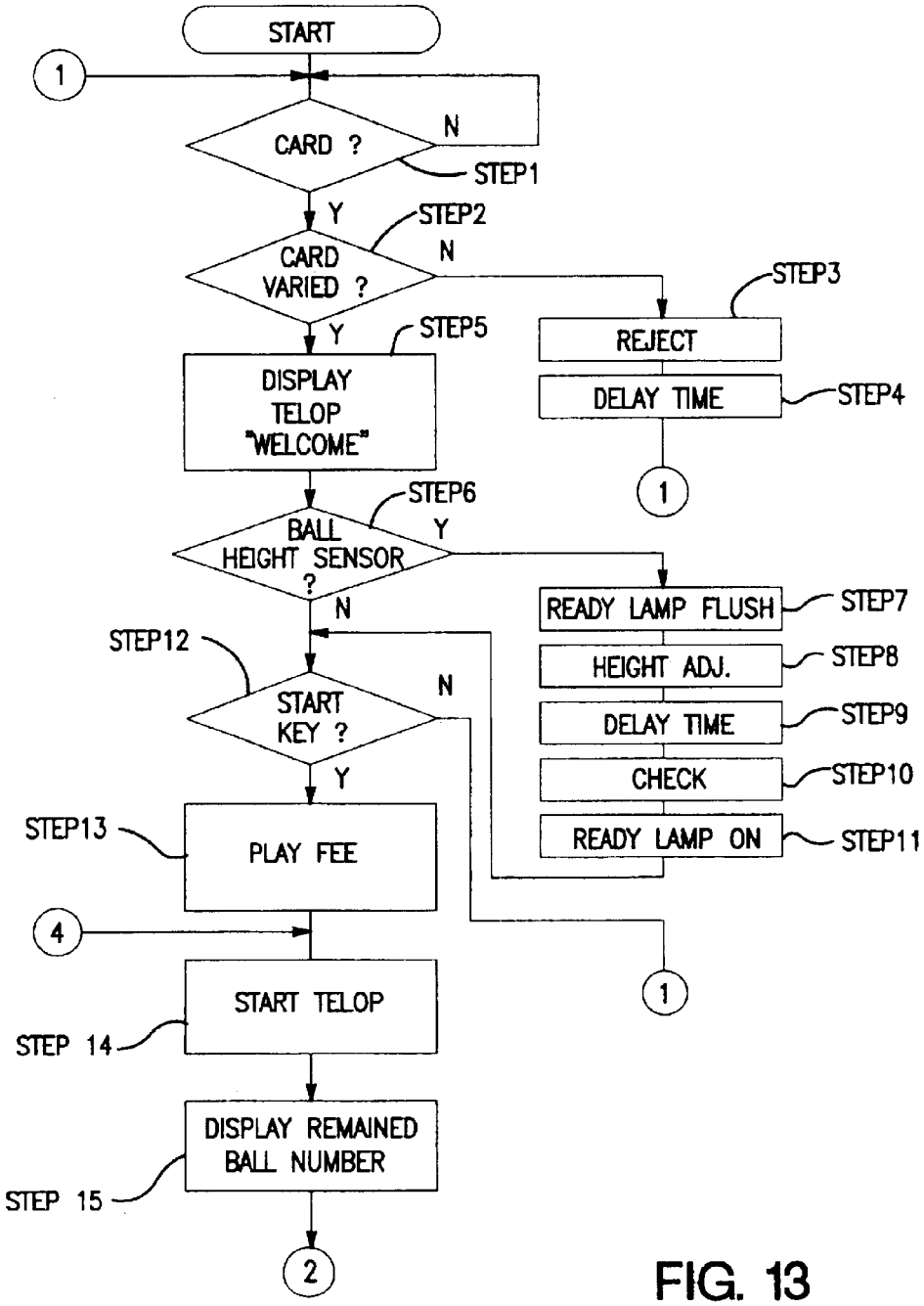
FIGS. 13 to 15 show a flow chart of video batting system.

In FIG. 13, the player (batter 8) puts a card purchased at the card vending machine 20 (FIG. 1) into the controller 16 having a card reader/writer (STEP 1). The controller 16 judges whether the card put thereinto is valid or not (STEP 2). If it is invalid, the controller 16 rejects the card and an invalid lamp (not shown) turns on (STEP 3). After the card is rejected, the status is turned back to STEP 1 with a delay time (STEP 4). If the card is valid, the pitcher's monitor 4 displays telop "WELCOME" and a ready lamp is put on (STEP 5). Then, the controller 16 checks whether the ball height sensor 12 must be operated or not (STEP 6). If the height at which a ball is pitched by the pitcher is not set, a ready lamp flashes (STEP 7). Then height adjustment is done (STEP 8), and a ready lamp turns with delay (STEPS 9, 10, 11). If the ball height adjustment is done, the player 8 presses a start key. If the start key is not pressed in STEP 12, the status turns back to STEP 1. When the start key turns on, the amount of play fee is withdrawn form the card (STEP 13). Thereafter, the pitcher's monitor 2 displays a still image of a pitcher as a start telop (STEP 14) with the number of remaining balls (STEP 15). Next, the pitching machine 3 starts (STEP 16) and a start pulse is outputted (STEP 17) to start a motion picture on the pitcher's monitor 2 (STEP 18).

Recognition for a ball r is done by the second area sensor 11 (STEP 19) and the first area sensor 10 (STEP 20). The fact a ball is pitched, is recognized by the area after a certain delay time from STEP 20, and the batter 8 hits the ball r. When the hit ball r goes through the first area sensor 10 (STEP 22), the position (Xn, Yn) at which the ball r crosses the first area sensor 10 is detected (STEP 23) Further, when the hit ball r goes through the second area sensor 11 (STEP 24), the position (Xn, Yn) at which the ball r crosses the second area sensor 11 is detected (STEP 25). If the hit ball r does not go through the two sensors 10, 11 for a predetermined time (time is out), the controller judges that the thrown ball is "STRIKE" (STEPS 26, 27). After the each sensor detects the ball position, the controller 16 calculates the angle and speed of the hit ball r, and displays position of the hit ball, score, home-run, average hit-rate, etc. (STEP 28). Then the controller checks the number of the remaining ball. If the ball number is not zero, the number of the remaining ball decreases (STEPS 29, 30). After the batter 8 hits a ball, the status turns back to STEP 4 and the batter 8 stands by for the next ball. If the number of remaining ball is zero, the pitcher's monitor 2 displays a telop "THANK YOU" (STEP 31) and a card alarm goes off to advise the player to take the card out of the controller (STEP 32). The card is taken out of the controller 2 by the player, the pitcher's monitor 16 displays a telop indicating that the system is not being used (STEPS 33, 34).

In the above embodiment, a card is used. However, instead of the card, a coin or token may be used.

According to this real-experience type sports-game system, the problem of a lack of actual feeling of playing baseball can be solved.

Figure 16:
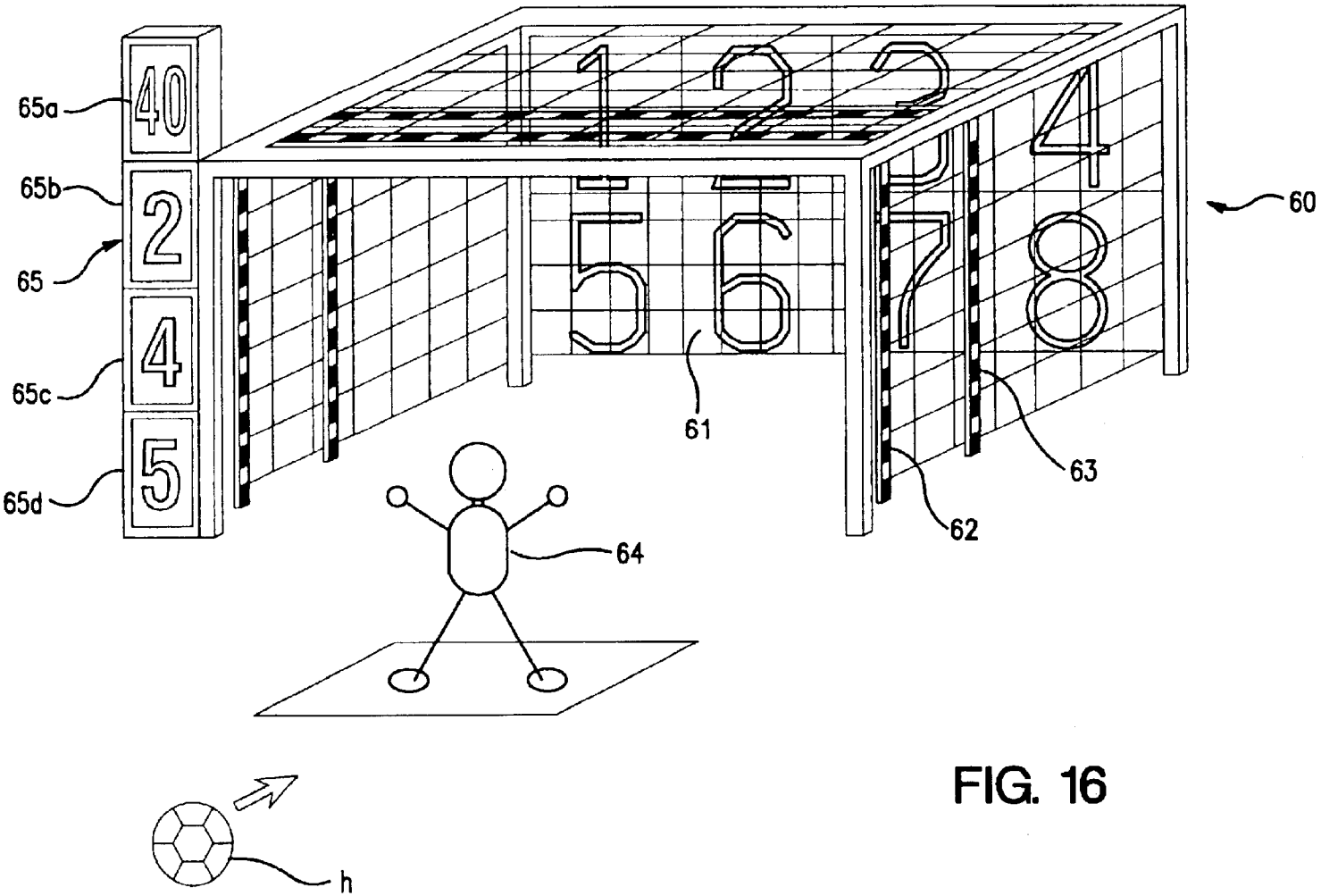
FIG. 16 shows a perspective view of a soccer game system.

FIG. 16 shows a soccer game system with a goal 60. The back fence 61 of the goal 60 are divided into a plurality of areas (8 areas in this embodiment) which earns different scores, respectively. First and second area sensors 62, 63 are provided, separately at a distance, near the entrance of the goal 60 to detect to which part of the goal 60 a kicked ball k by a player goes in and the speed of the kicked ball k. In front of the entrance of the goal 60, a robot goal keeper 64 is installed so as to be irregularly moved to the left and right. A ball k is thrown out from various angles by a ball feeding machine (not shown). The plural number of video monitors displaying a motion of a ball feeding players may be provided adjacent the ball feeding machine. The ball feeding machine may have an adjustment means for adjusting a feeding position of the ball to the player. The player earns scores according to the position of the ball detected by the area sensors 62, 63. The player earns higher scores when he kicks the ball into the particular position pre-registered by a computer. At the side of the goal entrance is provided a display plate 65 which has a first display face 65*a* for showing a ball speed, a second display face 65*b* for showing a score, a third display face 65*c* for showing a goal position of the ball to be kicked into the goal, indicated by the computer and a fourth display face 65d for showing number of the remaining balls to be kicked. According to this soccer system, the game will not become monotonous and a high-quality excitement is given.

This system can be adopted for tennis, cricket and other sports system. Also, in this case, a ball is shot by several shooting machines at various angles at different speeds controlled by a computer.

The previously proposed system discloses two area sensors 10, 11, each of which has both vertical and horizontal sensor lines in order to identify a position, speed and direction of a ball. The speed and direction of the ball are derived from calculation based on the positions of the sensor 10 (Xn, Yn) and the sensor 11 (Xn, Yn).

Figure 17:
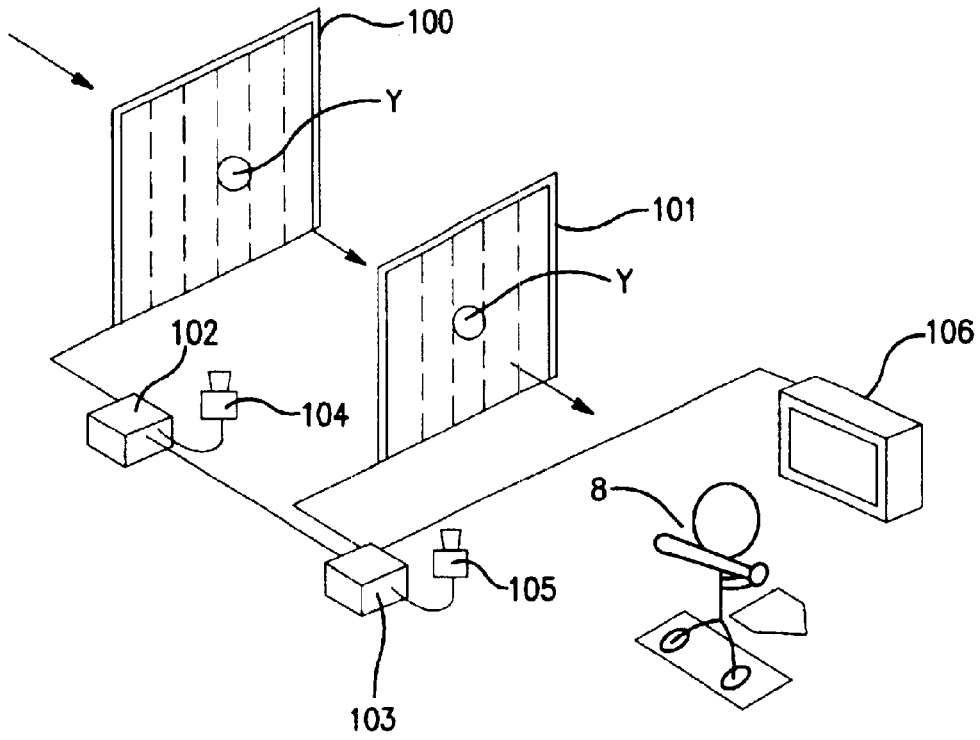
FIG. 17 shows another embodiment of a perspective view of the area sensors.

FIG. 17 shows another embodiment of the system. In FIG. 17, two sensors 100, 101 are disposed at a predetermined distance. Each sensor has only one-direction sensor lines S, L. In this embodiment, a plurality of vertical sensor lines S, L are formed at a predetermined pitch in each sensor. The sensor 100 is connected to an image processing machines 102 which has a digital camera 104. The camera 104 takes still photos of the ball r at the moment when it goes through the sensor 100. The sensor 101 is connected to an image processing machine 102 which has a digital camera 105 having the same function as the camera 104.

The two image processing machines 102 and 103 are connected to each other and calculate the speed and direction (location) of the ball r fed by a pitching machine and the speed, direction and flying distance of the ball r hit by the batter 8 on the bases of the positions of the still photos, of each sensor 100, 101, of the ball r going therethrough. At the moment when the ball r goes through each sensor, a trigger pulse is inputted into an image processing machine 100, 101 to operate each camera and to process each still photo. The speed, direction and flying distance hit by the batter 8 and its speed and direction pitched by the pitching machine are displayed on a monitor 106 set in front of the batter 8.

The difference between the previous system and the proposed system is the number of the sensors to be required. The proposed system which requires only one-direction sensor is far less expensive than the previous system which requires the two-direction sensors. Each processing machine 100, 101 has a function to identify which ball the batter 8 could hit well and which balls he missed or could not hit well.

When a ball pitched by a pitching machine or a pitcher goes through the sensors 100, 101, the system identifies the direction and the speed of the ball r based on a calculation of the positions of the ball r and the time when the ball r passes through each sensor 100, 101.

By changing the speed, direction of pitched balls, the batter 8 can obtain data of his hitting record based on kinds of balls in a form of hard copy or on the monitor 106.

I claim:

1. A sports game system in which a player uses a ball, comprising:

first and second area sensors for measuring speed of a ball at a moment when the ball goes through the sensors, each of said area sensors being a one-direction area sensor having only one-direction vertical sensor lines arranged at a predetermined pitch, said first and second area sensors being disposed at a predetermined distance;

first and second cameras arranged to capture still photos of the ball as the ball passes through said first and second area sensors, respectively, to identify location of the ball therein; and first and second image processors operatively connected respectively to said first and second area sensors and said first and second cameras for detecting speed and location of the ball passing through the area sensors or detecting speed, location and flying distance of the ball hit by a player based on image information of the still photos obtained by the cameras, respectively, said first and second image processors being operatively connected to each other, and a monitor unit which is connected to one of said first and second image processors and on which obtained data are displayed.

2. A sports game system according to claim 1, wherein one of said first and second image processors has a function to identify which balls the player could hit well and which balls the player missed or could not hit well.

3. A sports game system according to claim 1, further comprising a TV monitor for displaying a motion of a life-size image of a ball feeding person who feeds the ball to a player and a ball feeding machine for feeding the ball synchronizing the motion of the ball feeding person, the TV monitor being provided adjacent the ball feeding machine.

4. A sports game system according to claim 3, wherein said TV monitor displays an image picture of the motion of said ball feeding person through an image processor which has a digital memory for storing an image picture from a video CD.

5. A sports game system according to claim 4, wherein said TV monitor comprises a multiple number of video monitors disposed vertically to show a life-size image of said ball feeding person without a gap between the monitors.

6. A sports game system according to claim 3, wherein said ball feeding machine has an adjustment means for adjusting a feeding position of the ball to the player in accordance with a signal from a ball position determining device for determining a position of the ball desired by the player.

7. A sports game system according to claim 1, further comprising a printer for printing out players'result data.

8. A sports game system according to claim 1, wherein controller has a card reader/writer for reading and writing various data on the card.

9. A sports game system according to claim 1, wherein a monitor is provided adjacent the ball feeding machine for displaying at least one of speed, direction or flying distance of the ball hit by the player and speed, or direction of the ball pitched by the ball feeding machine.

10. A sports game system, comprising:

first and second area sensors, each of the area sensors producing only vertically arranged, one-directional sensor lines arranged at a predetermined pitch, the first and second sensors being arranged at a predetermined distance from one another;

first and second cameras positioned to capture first and second still photos of an area of said first and second area sensors, respectively; and first and second image processors operatively connected to one another and also respectively to said first and second area sensors and said first and second cameras so that when a respective one of the first and second area sensors detects a ball passing therethrough, the corresponding image processor causes the corresponding camera to capture a still photo of the ball as the ball passes through the corresponding area sensor, the first and second processors being further structured to calculate a speed and direction of the ball as the ball travels toward a player based on a location of the ball in the first and second still photos, a time lapse between the first and second still photos, and the predetermined distance between the first and second area sensors.

11. The sports game system of claim 10, wherein the first and second processors are further constructed and arranged to calculate a speed, direction, and flying distance of the ball after being hit by the player.

12. The system of claim 10, further comprising a monitor unit which is connected to one of said first and second image processors so that the monitor unit displays data related to the speed and direction of the ball.

13. The system of claim 11, further comprising a monitor unit which is connected to one of said first and second image processors so that the monitor unit displays data related to the speed and direction of the ball as the ball travels toward the player, as well as speed, direction, and flying distance of the ball after being hit by the player.

* * * * *